US005571063A

United States Patent [19]

Ivanov

[11] Patent Number: 5,571,063

[45] Date of Patent: Nov. 5, 1996

[54] CYCLOERGOMETER FOR IMPROVED FUNCTION OF IMPAIRED HEART

[76] Inventor: Yakov Ivanov, 3909 N. Murray Ave., Apt. 209, Shorewood, Wis. 53211-2306

[21] Appl. No.: 533,849

[22] Filed: Sep. 26, 1995

Related U.S. Application Data

[63] Continuation-in-part of Ser. No. 410,862, Mar. 10, 1995, abandoned.

[51] Int. Cl.[6] ..... A63B 69/16; A61B 5/024

[52] U.S. Cl. ..... 482/57; 482/8; 128/707

[58] Field of Search ..... 482/51, 57, 3–9; 128/707, 706; 73/379

[56] References Cited

U.S. PATENT DOCUMENTS

| | | | |
|---|---|---|---|
| 3,395,698 | 8/1968 | Morehouse | 128/707 |
| 3,744,480 | 7/1973 | Gause et al. | 128/707 |
| 4,436,097 | 3/1984 | Cunningham | 482/57 |
| 5,001,632 | 3/1991 | Hall-Tipping | 482/8 |
| 5,297,558 | 3/1994 | Acorn et al. | 128/707 |
| 5,323,784 | 6/1994 | Shu | 128/707 |

*Primary Examiner*—Stephen R. Crow
*Attorney, Agent, or Firm*—Kajane McManus

[57] ABSTRACT

The cycloergometer for the training of an impaired heart is of the type creating a constant load and nearly identical load for any exercising person, the load being applied with the person in a supine position. The apparatus comprises a platform for accommodating the supine person and a vertically adjustable loading unit positionable at a predetermined height above the platform, the loading unit generating a resistance or load of 15±5 watts. A control/monitoring unit with a preprogrammed data processor is connected to various sensors to monitor specific parameters set forth in the program.

The cycloergometer produces a pure volume load under program control against diminished peripheral resistance at a low heart rate and substantially maximized stroke volume which improves cardiac function.

1 Claim, 3 Drawing Sheets

CYCLOERGOMETER FOR IMPROVED FUNCTION OF IMPAIRED HEART

CROSS REFERENCE TO RELATED APPLICATIONS

This application is a continuation-in-part of U.S. application Ser. No. 08/410,862 filed Mar. 10, 1995, now abandoned.

BACKGROUND OF THE INVENTION

1. Field of the Invention

This invention relates to stationary cycloergometers, specifically to such cycloergometers which are used for dosed exercise.

2. Prior Art

Individuals commonly use cycloergometers to improve their physical condition. However when those with impaired cardiac function use such device for producing improved cardiac function, certain parameters must be considered.

Originally, the physical conditioning of such persons was performed at a low level of intensity, but this was not found to be of substantial benefit.

Thereafter, cycloergometers providing an exact dosage together with monitoring of the heart rate and/or electrocardiogram were developed.

This approach to conditioning has the following drawbacks:

1. The need for exercise tolerance testing, which in and of itself may produce risks;

2. The need for supervision and monitoring equipment;

3. The improvement of extracardiac circulation rather than of cardiac function;

4. The unavailability of use for persons with low functional reserves.

The physical load provided to those with impaired cardiac function is essentially the same as that offered to those with normal cardiac function but is adjusted to the functional ability of the impaired heart through the decrease of intensity and duration.

Accordingly, during the application of a physical load to a heart, the heart must produce an increased rate, stroke volume, and elevated systolic blood pressure, as known.

Thus, an impaired heart must accommodate the tri-component load defined above. However, an impaired heart increases stroke volume abnormally by increasing end-diastolic volume, while a healthy heart increases stroke volume by diminishing end-systolic volume. Therefore a positive result from load application cannot be expected because of this abnormal accommodation.

Russian Inventors Certificate No. SU #1238758 discloses one system successful in reducing the tri-component load to a one-component load.

Such system, however, is not adaptable for use by a lay person.

SUMMARY OF THE INVENTION

Accordingly, several objects and advantages of the present invention are:

(a) to provide a cycloergometer which can be reproducibly manufactured;

(b) to provide a cycloergometer which improves cardiac function;

(c) to provide a cycloergometer which provides control of compliance, and (d) to provide a method of use which is conveniently usable by a lay person.

Still further objects and advantages will become apparent from a consideration of the ensuing description and drawings.

DESCRIPTION OF THE PREFERRED EMBODIMENT

Figure 1:
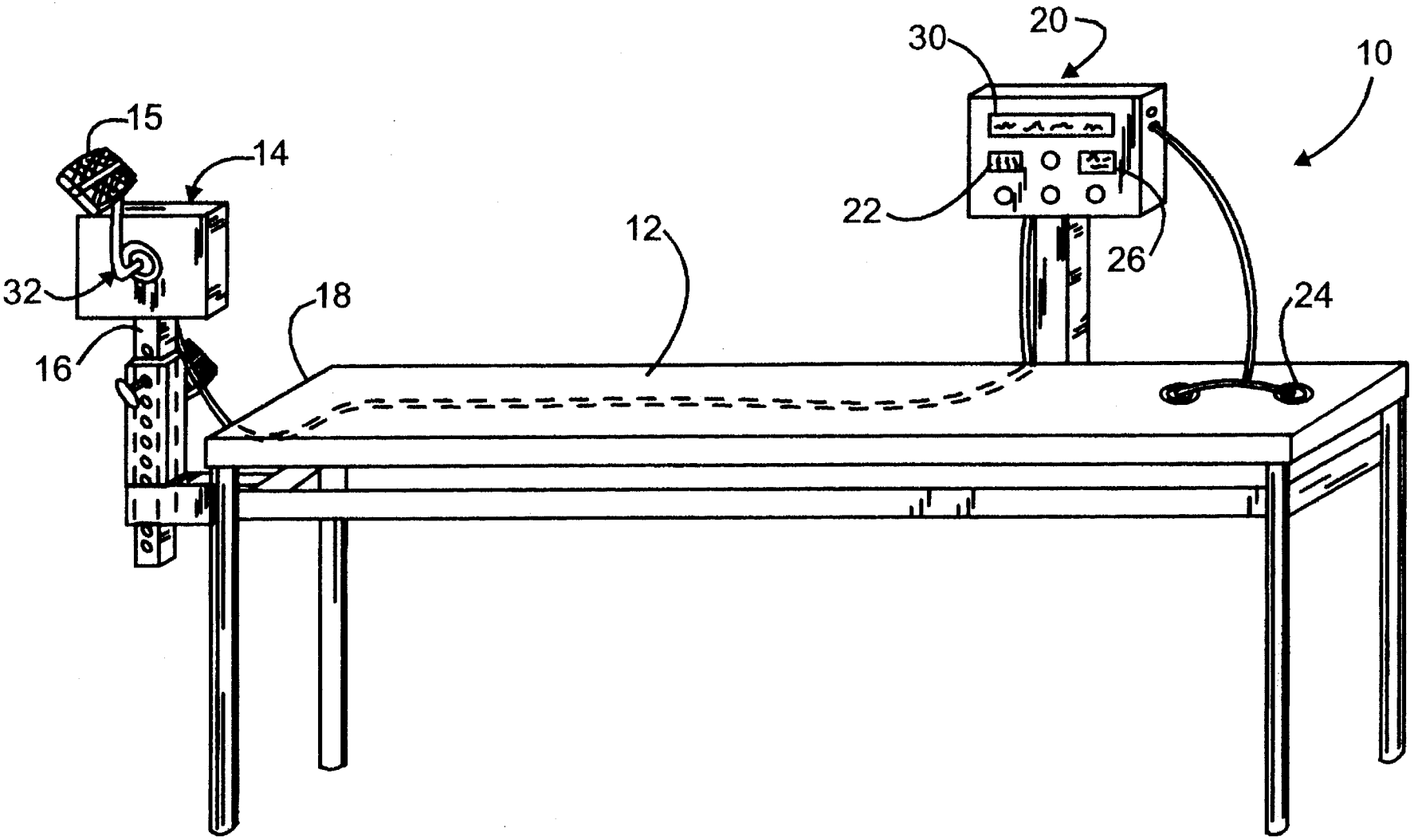
FIG. 1 is a perspective view of the cycloergometer of the present invention.

An exemplary embodiment of the cycloergometer 10 of the present invention is illustrated in FIG. 1.

The cycloergometer 10 includes a resting platform 12 for accommodating a supine body and a loading unit 14 which generates a load of 15± 5 Watts, the load being created when one cycles the pedals 15 of the unit 14 at a predetermined rate as will be defined further hereinafter. This loading unit 14 is attached to a vertical bar 16 which is vertically adjustable allowing for the movement of the loading unit 14 relative to the height of the resting platform 12. The bar 16 is attached centrally to a leg end 18 of the horizontal resting platform 12 in any known, suitable manner.

Also provided is a control/monitoring unit 20 which is attached to the platform 12 at a position to allow its visibility to the exercising person. This unit 20 includes a sensor (not shown) functionally engaged to clock the rotational frequency developed in the pedals 15, the frequency being indicated by an indicator 22. The monitoring/control unit 20 further includes a sensor 24 which is functionally engaged to the exercising person to sense the heart rate, with such rate being indicated on an indicator 26. The control/monitoring unit 20 also has an internal time sensor or timer.

The control/monitoring unit 20 further includes a general purpose data processor (not shown) which processes a specific formula to be defined.

The control/monitoring unit 20 first receives input from the heart rate sensor generated when the person has spent seven minutes in a supine resting position on the platform 12. The time sensor clocks off the seven minute period and the heart rate sensed during the period becomes a reference for calculating a maximum point for exercising heart rate for a particular session. This point is calculated within the processor by applying a formula: Point=0.8 HRr+46, where HRr is the resting heart rate calculated as defined above, and 46 is a constant. The constant of 46 was derived by statistical manipulation of response data generated by 200 people placed under steady state load.

Resting heart rate must be within predefined limits of 50 to 100 beats per minute. If resting heart rate is outside these limits, the individual is not able to proceed with exercise. Such person would be directed to seek professional intervention.

A pedal rotation frequency of between 40 and 55 rotations per minute has been found to create the desired heart rate point for load with preferred limits being 45–50 rpm. The control/monitoring unit 20 includes signaling means 30 which produce a signal when deviation from the desired load level occurs.

It has been defined that the load unit 14 is vertically adjustable relative to the resting platform 12. Such adjustment capability is desired because placement of the axis 32 about which the pedals 15 rotate has been found through empirical testing to be dependent on specific body structure for producing the desired load.

In this respect, the load must be above supine level with the elevation being determined to be from ½ to ¾ of the individual's thigh length as measured from the trochanter. The desired height is maintained for each individual throughout the course of training.

In use, one first adjusts the height of rotational axis 32 for the pedals 15 to the predetermined position relative to the platform 12.

One next assumes a supine position on the platform 12, legs toward the loading unit 14 and places the feet on the pedals 15, moving one pedal 15 to the furthest arcuate extent and manipulating the body on the platform 12 so that the extended leg is slightly bent at the knee.

One then extends the legs horizontally along the platform 12 and assumes a relaxed position. The heart rate sensor 24 is then engaged to the body and the control/monitor unit 20 is turned on.

Once the time sensor clocks off seven minutes and a resting heart rate within predefined limits is determined, a start signal is generated and pedalling begins at the desired rotational frequency of 40–55 rpm, such rotational effort being monitored by the control monitor/unit 20 and being displayed for the user's view.

The duration of the exercise session is limited by the appearance of fatigue, or other signs which usually require cessation of physical activity, or, for no longer than 40 minutes, past which point it has been found through testing that no substantial benefit is derived. Frequency of such sessions is preferably three times daily for those with severe cardiac impairment down to every other day for those with improved cardiac function.

As described above, the cycloergometer 10 can be used for exercising easily and conveniently, obviates need for stress testing, obviates the need for the high load accommodation, enables people with low cardiac function to exercise, provides for individualized adjustment to the anatomy, provides accommodation to the cardiac status during the particular session, allows for frequent exercise, creates a pure volume load, and improves cardiac function.

Figure 2A:
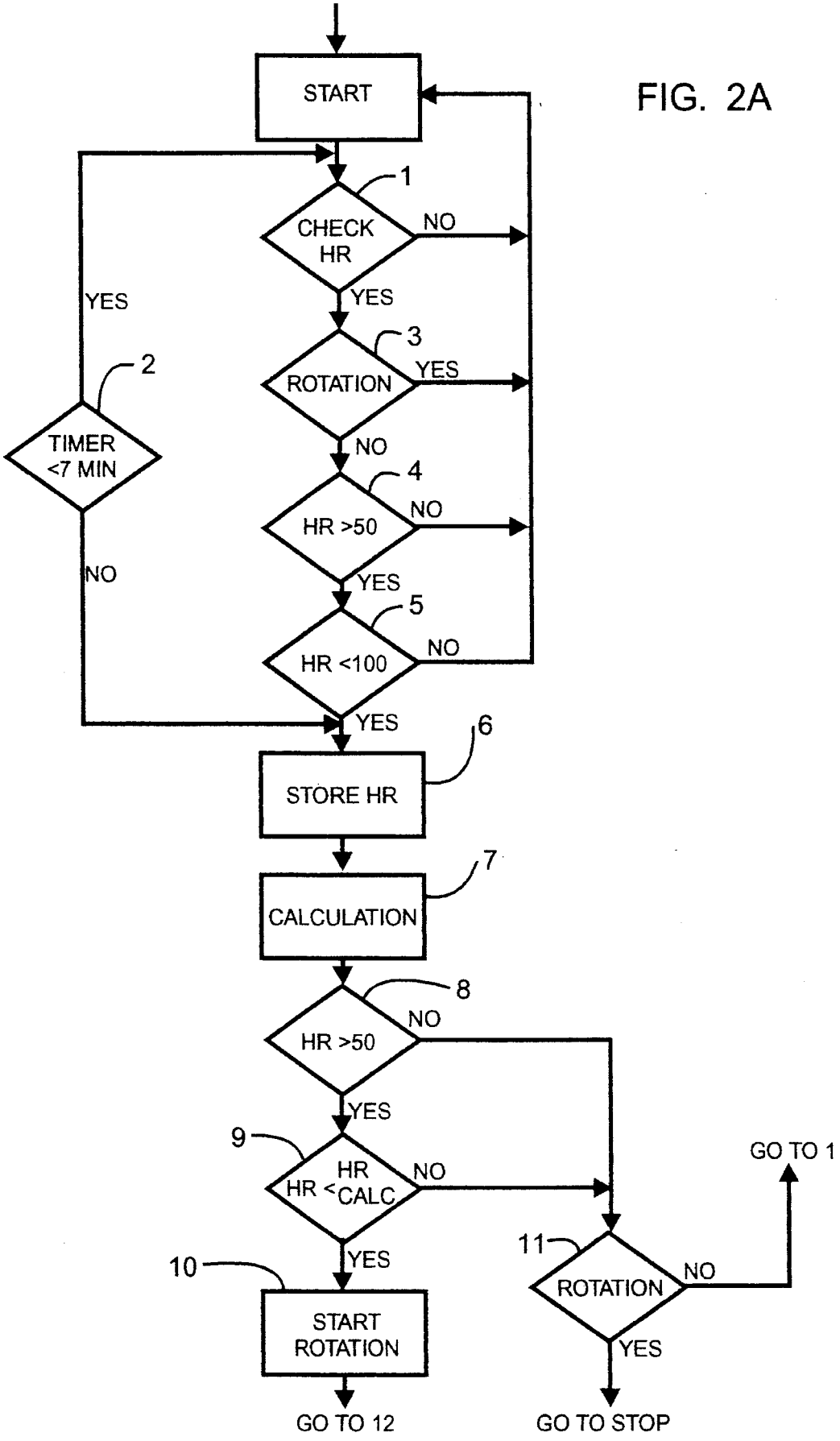
FIGS. 2A and 2B comprise a flow chart of the methodology used in the apparatus.
Figure 2B:
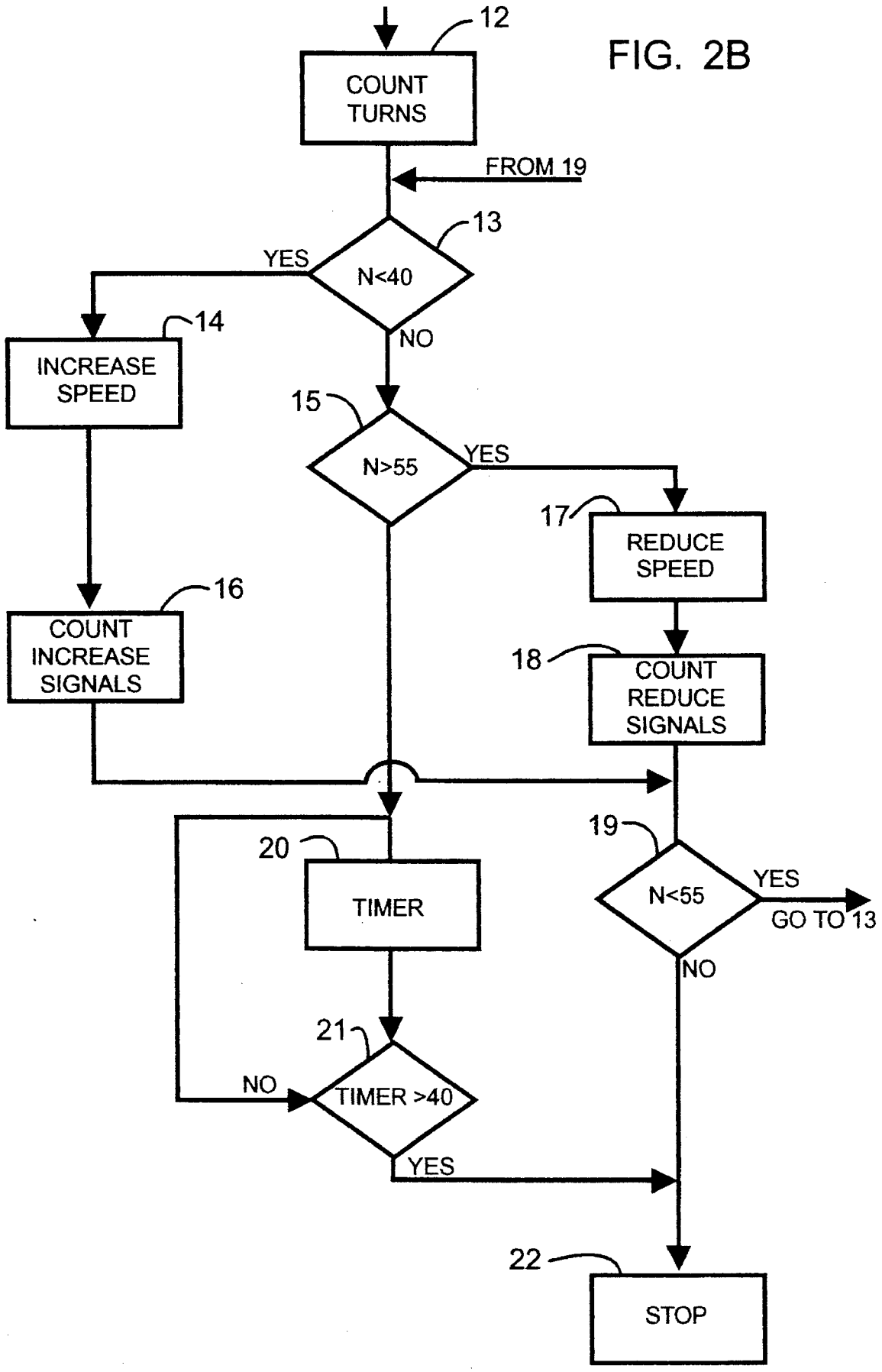

Turning now to FIGS. 2A and 2B, it will be seen that programming for the control unit 20 is application specific.

In this respect, with all sensors being functionally engaged to their respective inputs and with their outputs being engaged to the control unit 20, which in turn is engaged to output devices available for communicating sensed parameters to the user, upon activation of the control unit, several things occur.

First, during a seven minute interval, resting heart rate is monitored to provide a reference point for calculation of desired rate (steps 1–7).

Once preset functional parameters are met, exercise in the form of pedal 15 rotation is begun, with the number of rotations being counted and excessive or too few rotations being indicated to the user (steps 8–18) for restructuring to maintain a rate within the specified range.

The timer is set during the course of exercise to indicate when approximately 40 minutes have elapsed, signalling an end of session to the user (steps 20–22).

From the description above, a number of advantages of the cycloergometer 10 of the present invention become evident:

(a) The load created on the impaired heart is low;

(b) The low load created is tolerated well by the majority of those with cardiac impairment;

(c) The creation of a nearly identical load for all users obviates the need for stress testing of users and/or adjustment of load stress;

(d) The formula processed within the processor takes into account the instant status of the individual, and accommodates the instant heart rate based on resting heart rate.

(e) The apparatus produces a pure volume load for the heart, which is the result of the combined created load and supine positioning of the person, with the combined result leading to increased venous return and heart volume without creating an increase of systolic blood pressure;

(f) The pure volume load creates improved cardiac contractility, perfusion and subsequently, improved cardiac function.

Although the description postulates many specifics, these should not be construed as limiting but as merely providing illustrations of the presently preferred embodiment of the invention.

Thus the scope of the invention should be determined by the appended claims and their legal equivalents, rather than by examples given.

I claim:

1. A method for exercising an impaired heart using a cycloergometer comprising:

a platform which accommodates a supine human body, the platform having a leg end and a head end;

a loading unit mounted at the leg end of the platform in a manner to be vertically adjustable relative to the platform and including a pair of joined rotatable pedals;

a sensor for engagement to a human for sensing of heart rate;

a sensor for sensing the rate pedal rotation;

a time sensor;

a central processor for receiving sensor input and carrying out a predefined program based on the sensor input, and means for outputting sensor and programming output; the method including the steps of:

determining an average resting heart rate which must be between 50 and 100 beats per minute;

calculating a formula for determining a maximum exercising heart rate point=0.8 HRr+46 where HRr is resting heart rate and 46 is a constant;

beginning exercise by pedalling and monitoring the number of pedal rotations to maintain rotations per minute between 45 and 55 and monitoring heart rate to maintain same near the calculated exercising heart rate point, and indicating when predefined heart rate and rotation frequency are outside predefined limits for user pedal action correction; and indicating when 40 minutes have elapsed.

* * * * *